United States Patent [19]

Bauzhis et al.

[11] 4,228,414

[45] Oct. 14, 1980

[54] MAGNETIC DEFLECTION SYSTEM

[76] Inventors: Albertas V. Bauzhis, ulitsa Marshala Krylova, 34, kv. 50; Petr P. Kornyak, ulitsa Daryaus-Gireno, 8, kv. 90; Vitautas K. Razhaitis, ulitsa Greifenbergerisa, 3, kv. 27; Ioselis K. Shneideris, ulitsa Gagarina, 5, kv. 28, all of Vilnjus, U.S.S.R.

[21] Appl. No.: 3,517

[22] Filed: Jan. 12, 1979

[51] Int. Cl.[2] ..... H01F 5/00

[52] U.S. Cl. ..... 335/213; 335/210

[58] Field of Search ..... 335/210, 211, 212, 213

[56] References Cited

U.S. PATENT DOCUMENTS

| | | | |
|---|---|---|---|
| 2,395,736 | 2/1946 | Grundmann | 335/213 |
| 4,078,301 | 3/1978 | Renders et al. | 335/213 X |

*Primary Examiner*—George Harris

*Attorney, Agent, or Firm*—Steinberg and Blake

[57] ABSTRACT

A magnetic deflection system comprising a cylindrical magnetic circuit which surrounds two pairs of saddle-shaped deflection coils, horizontal and vertical, fitted coaxially with the magnetic circuit and at right angles to each other, each said coil being provided with a longitudinal portion and a lateral portion which mate together through a jointing area, each said jointing area having its cross-section of a variable thickness, which cross-section diminishes from a maximum value measured along a section through a boundary line of the jointing area limiting either the longitudinal portion or the lateral portion to a minimum value measured along a diagonal section that passes through the jointing area at right angles to the deflection plane of the electron beam.

1 Claim, 3 Drawing Figures

MAGNETIC DEFLECTION SYSTEM

FIELD OF THE INVENTION

The invention relates to construction elements of cathode-ray tubes namely, deflection systems thereof, and more particularly, to magnetic deflection systems. The invention is applicable to television cameras utilizing vidicons and similar tubes.

DESCRIPTION OF THE PRIOR ART

Known in the art is a magnetic deflection system comprising a cylindrical magnetic circuit which surrounds two pairs of saddle-shaped deflection coils, horizontal and vertical, which are fitted coaxially with the magnetic circuit and at right angles to each other, said coils being provided with longitudinal and lateral portions which mate together through a jointing area, a diagonal section passing through each such jointing area at right angles to the deflection plane of the electron beam being adapted to accommodate the wires of a respective coil which are sectionalized.

Such an embodiment ensures a standard condition in which wires are laid in a coil so that the areas of all the sections through the coil at right angles to the wires are equal to one another, which provides for stable electron-optical characteristics of the deflection system.

However, the coil turns in sectionalized groups are positioned in a discrete manner at fixed locations throughout a considerable portion of the trajectory of the electron beam ($\frac{2}{3}$ of the total length of the deflection system, approx.), with the result that the magnetic deflecting fields are distributed unevenly in both the longitudinal sections through the system and the sections at right angles to the longitudinal axis of the systems. This results in aberrations in the deflection of the electron beam; for example, there results inadequate defocusing action of the system fields on the electron beam at some points in the above sections and the resolution of visual data obtained from the vidicon target cannot therefore be increased.

Moreover, the described deflection system is based on sophisticated fabrication techniques which offer low efficiency due to the fact that the coil turns must be sectionalized in the diagonal sections passing through the jointing areas between the longitudinal and lateral portions of the coils at right angles to the deflection planes of the electron beam.

SUMMARY OF THE INVENTION

An object of the invention is to provide for smaller abberrations in the deflection of the electron beam by virtue of much even distribution of the magnetic deflecting fields.

Another object of the invention is to provide for better effectiveness of fabrication of the magnetic deflection system.

According to the invention there is provided a magnetic deflection system comprising a cylindrical magnetic circuit which surrounds two pairs of saddle-shaped deflection coils, horizontal and vertical, fitted coaxially with the magnetic circuit and at right angles to each other, each of said coils being provided with a longitudinal portion and a lateral portion which mate together through a jointing area, each of said jointing areas having its cross-section of a variable thickness, which cross-section diminishes from a maximum value measured along a section through a boundary line of the jointing area limiting either the longitudinal portion or the lateral portion to a minimum value measured along a diagonal section that passes through the jointing area at right angles to the deflection plane of the electron beam.

Such a design provides for even distribution of the magnetic deflecting fields of the system.

DESCRIPTION OF THE DRAWINGS

Other features and advantages of the invention will be apparent from the following description of a preferred embodiment of the invention, taken in conjunction with the accompanying drawings in which.

DESCRIPTION OF THE INVENTION

Figure 1:
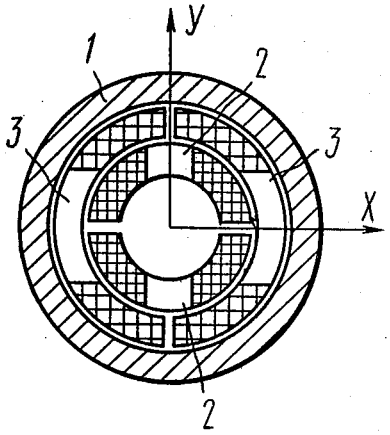
FIG. 1 is a cross-section of a magnetic deflection system, according to the invention.

Referring to FIG. 1, a cross-section of the magnetic deflection system of the invention is shown. Here, a magnetic circuit 1 surrounds two pairs of saddle-shaped deflection coils, horizontal, 2, and vertical, 3, which are fitted coaxially with the magnetic circuit 1 and at right angles to each other.

Figure 2:
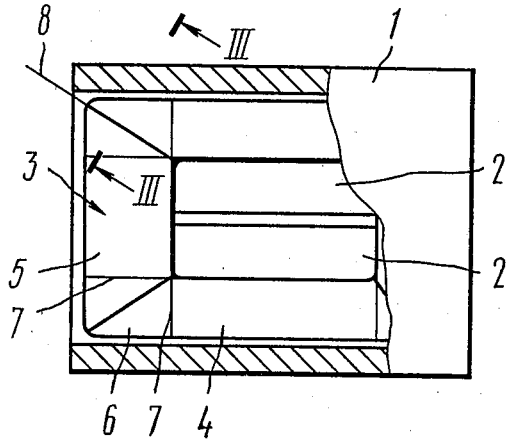
FIG. 2 is a partial longitudinal section of the magnetic deflection system, according to the invention.

FIG. 2 is a partial longitudinal section of the magnetic deflection system of the invention, which shows the vertical deflection coils 3 with their longitudinal portions 4 and their lateral portions 5 which mate together through a jointing area 6 having boundary lines 7.

Figure 3:
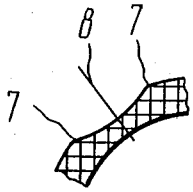
FIG. 3 is a partial section of the jointing area of a coil, taken along the line III–III of FIG. 2, according to the invention.

FIG. 3 is a partial section, on an increased scale, of the jointing area 6 of the vertical deflection coil 3, taken along the line III—III of FIG. 2. The jointing area 6 has a variable thickness of its cross-section which diminishes from a maximum value measured along a section through the boundary line 7 of the jointing area 6 limiting either the longitudinal portion 4 or the lateral portion 5 to a minimum value measured along a diagonal section (the line 8) that passes through the jointing area 6 at right angles to the deflection plane of the electron beam.

The magnetic deflection system of the invention operates as follows.

The flow of currents from the sweep generator through the horizontal, 2, (FIG. 1) and vertical, 3, deflection coils establishes magnetic fields to deflect the electron beam of the vidicon tube to respective directions, so that the beam provides for a visual display of data obtainable from the vidicon target.

According to the invention, a condition is provided in which the wires of the deflection coils 2, 3 are laid in a standard manner, so that the areas of all the sections through these coils 2, 3 at right angles to the wires are equal to one another; therefore, the stability of the electron-optical characteristics of the system, such as picture resolution, geometrical distortion, etc., is attained.

The above-mentioned condition is satisfied due to the fact that each of the jointing areas 6 in the deflection coils 2, 3 (FIG. 2) has a variable thickness of its cross-section which diminishes from a maximum value measured along a section through the boundary line 7 of the jointing area 6 limiting either the longitudinal portion 4 or the lateral portion 5 to a minimum value measured along a diagonal section (the line 8) that passes through the jointing area 6 at right angles to the deflection plane of the electron beam. This allows for the use of nonsectionalized turns of the coils 2, 3 with the result that a much better distribution of the magnetic deflecting fields in the system is obtained and that the coils 2,3 can be manufactured in a much easier way.

The object of the invention have been realized in the deflection system of the vidicon of a portable television camera. With the latter manufactured on a mass production basis, the advantages of the invention are of great importance.

What is claimed is:

1. A magnetic deflection system comprising:

a cylindrical magnetic circuit;

two pairs of saddle-shaped deflection coils, horizontal and vertical, disposed at right angles to each other within said magnetic circuit in coaxial relationship therewith;

each of said coils having a longitudinal portion and a lateral portion which mate together through a jointing area;

said jointing area of each said coil has its cross-section of a variable thickness, which cross-section diminishes from a maximum value measured along a section through a boundary line of the jointing area limiting either said longitudinal portion or said lateral portion to a minimum value measured along a section that passes through the jointing area at right angles to the deflection plane of the electron beam.

* * * * *